United States Patent [19]

Kawai

[11] 3,948,189

[45] Apr. 6, 1976

[54] POURING LADLE AND POURING PLATFORM CAR FOR USE THEREWITH

[75] Inventor: Takashi Kawai, Tokyo, Japan

[73] Assignee: Hitachi Metals, Ltd., Japan

[22] Filed: July 16, 1974

[21] Appl. No.: 488,924

[30] Foreign Application Priority Data

July 20, 1973 Japan ..... 48-80589

[52] U.S. Cl. ..... 105/271; 222/547

[51] Int. Cl.[2] ..... B61D 9/02

[58] Field of Search..... 222/DIG. 7, DIG. 8, DIG. 9, 222/547; 105/370, 371, 372, 358, 367, 271

[56] References Cited

UNITED STATES PATENTS

| | | | |
|---|---|---|---|
| 1,344,688 | 6/1920 | Griner | 222/DIG. 9 |
| 3,192,875 | 7/1965 | Kroe | 105/271 |

*Primary Examiner*—M. H. Wood, Jr.

*Assistant Examiner*—Church Gene A.

*Attorney, Agent, or Firm*—Craig & Antonelli

[57] ABSTRACT

A pouring ladle and a platform car for use therewith are disclosed, the aforesaid ladle having a partition wall therein which has a passage adjacent to its bottom for allowing the communication of the melts separated by said wall, said wall being positioned in said ladle between the inclining center, i.e., a fulcrum of said ladle and the center of gravity of the melt contained therein, thereby suppressing a wave-forming phenomenon accruing from the inclinging movement of the ladle, with the resultant smooth pouring operation. This ladle is mounted on a frame body of a platform car in a manner to permit its inclination toward a casting mold, said platform car being capable of travelling in synchronism with the speed of a mold conveyor and adapted to move in the direction toward the casting mold, thereby presenting improved efficiency for casting operation, coupled with improved safety.

27 Claims, 8 Drawing Figures

POURING LADLE AND POURING PLATFORM CAR FOR USE THEREWITH

This invention relates to a pouring ladle adapted for use in pouring a melt into a casting mold mounted on a mold conveyor and a platform car for use therewith.

Hitherto, it is a common practice for pouring a melt into casting molds mounted on a mold conveyor to use a mold conveyor, above which is provided a mono-rail, with a pouring ladle suspended through the medium of a trolley wheel from the aforesaid mono-rail. Thus, as the mold conveyor advances, an operator has to move a ladle and incline same to effect the pouring operation.

However, such a prior art ladle suffers from disadvantages of the accompanying danger, when a large capacity of a ladle is handled, because the ladle is moved and inclined by an operator manually. To remedy this danger, the use of a ladle of a small capacity is recommended but it presents poor efficiency because of increased cycles of receiving a melt into the ladle, in addition to the difficulties in handling a swinging ladle.

As is well known, the pouring operation of a melt into a casting mold largely depends on the results of castings, and there are many additional disadvantages to be solved with the prior art pouring ladle.

More particularly, with a ladle as shown in FIG. 1, when pouring a melt from the ladle 6' by inclining same in an arrow direction the height of an exit of the ladle 7 will vary depending on the start and completion phases of the pouring operation, because the ladle is inclined about the fulcrum P1, and so will be the distance of the aforesaid exit from a fixed point in the pouring direction of the ladle. This dictates the adjustment by moving the ladle 6' up or down and its inclination toward a casting mold as well as horizontal rotation, for pouring a melt into a sprue of a casting mold (not shown), thus resulting in complicated operation.

On the other hand, with the pouring ladle as shown in FIG. 2, the ladle has an inclining center or fulcrum P2 in the vicinity of the exit of the ladle, so that there is a considerable distance in the horizontal direction between the fulcrum P2 and the center of gravity G2 of the melt. Furthermore the fulcrum P2 is not freely supported in the same manner as shown in FIG. 1. Thus, when the ladle is inclined about the fulcrum P2 in the clockwise or counterclockwise direction as viewed in the drawing for pouring a melt into a casting melt, the center of gravity G2 of the melt will be shifted in the horizontal direction to a large extent. This energy is absorbed as a wave forming phenomenon appearing on the surface of the melt, while due to the wave forming phenomenon, a surging phenomenon will be incurred to the out-flowing speed of the melt, hindering a smooth pouring operation of casting.

It is the primary object of the present invention to provide a pouring ladle which may suppress the wave forming phenomenon and permits a stable pouring operation.

It is the secondary object of the present invention to provide a pouring platform car which permits the inclination for the ladle in the direction toward a casting mold and which is adapted to move the ladle in the longitudinal direction of the ladle, i.e., the pouring direction, while presenting high level of safety and efficiency in operation.

The pouring ladle according to the present invention features that an inclining center or fulcrum is positioned in the vicinity of the exit of the ladle and a partition wall is provided in the ladle between its fulcrum and the center of gravity of the melt, with a passage provided in said partition wall along the bottom of the ladle to thereby permit the mutual communication of the melts opposite sides of the partition walls.

The pouring platform car according to the present invention features that the platform car permits travelling at a relatively low speed in synchronism or non-synchronism relation to the speed of a mold conveyor as well as at a relatively high speed regardless of the speed of the mold conveyor, the aforesaid platform car being provided with a frame body mounted thereon which permits the inclining movement as well as the movement toward a casting mold, with the pouring ladle mounted on said frame body, and with the inclining center or fulcrum provided on the side of a casting mold.

FIGS. 3 to 6 show one embodiment of the present invention, in which FIG. 3 is a front view, FIG. 4 a cross-sectional view, taken along the line IV—IV of FIG. 3, FIG. 5 a cross-sectional view taken along the line V—V of FIG. 3, and FIG. 6 a cross-sectional view taken along the line VI—VI of FIG. 5;

Figure 1:
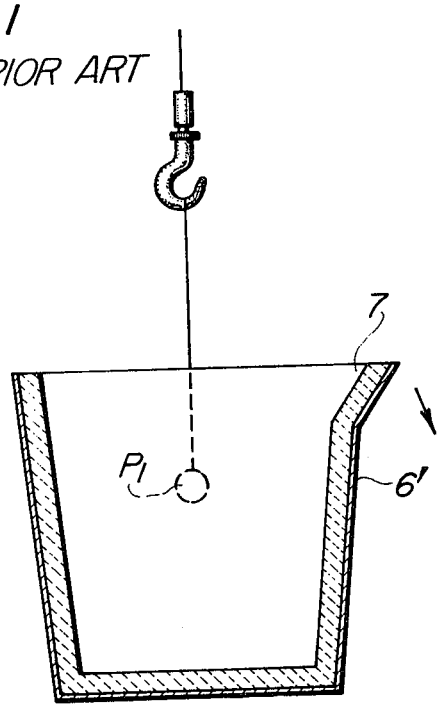
FIG. 1 PRIOR ART
FIGS. 1 and 2 are cross-sectional views of a pouring ladle according to the prior art.
Figure 2:
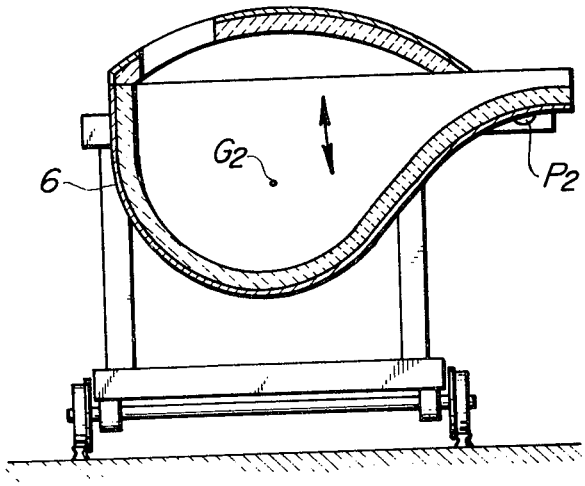
FIG. 2 PRIOR ART
Figure 3:
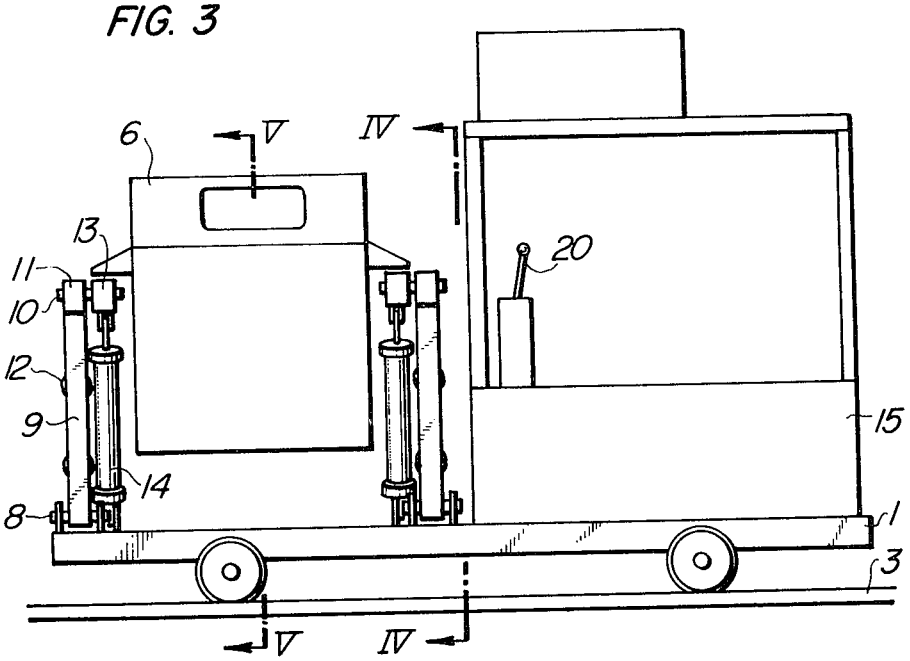
Figure 4:
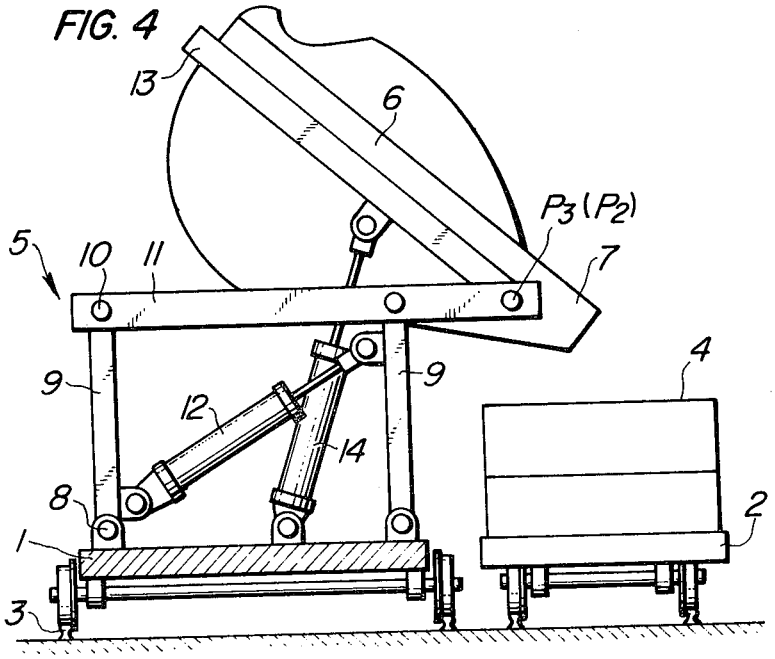
Figure 5:
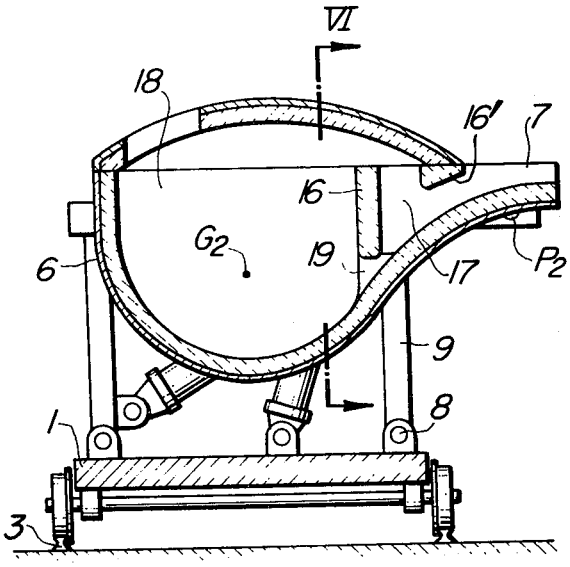
Figure 6:
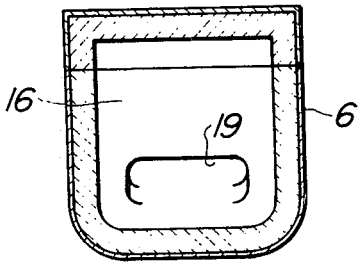

Now, description will be had of one embodiment of the present invention by referring to FIGS. 3 to 6. A platform car 1 travels on rails 3 laid on the ground in parallel with a mold conveyor 2. In addition, the platform car may travel at a low or high speed in synchronism with the speed of the mold conveyor 2 or irrespective thereof, respectively. It is needless to mention that the car 1 may stop at a desired position. In other words, the platform car 1 accomodates the continuous or intermittent travelling. In case the mold conveyor 2 travels continuously, the speed of the travelling platform car may be brought into synchronous relation to the speed of the mold conveyor by means of a synchronizing motor and the like whose rotation is controlled by means a signal current from an generator adapted to be rotated by means of a drive motor (not shown) for the mold coneyor 2. On the other hand, the platform car may travel or stop, irrespective of the advancing speed of the mold conveyor 2, by means of a motor provided separately.

Mounted on the front portion of the platform car 1 is a frame body 5 which permits the inclination and the movement toward a casting mold 4.

Furthermore, mounted on the frame body 5 through the medium of an inclining member 13 is a pouring ladle 6, with the exit 7 thereof directed toward the casting mold 4 on the mold conveyor 2. The frame body 5 is provided with a rocking member 9 which permits the rocking movement about a lower pin 8, i.e., a fulcrum, in the direction at a right angle to the rails 3, i.e., in the pouring direction of the ladle. Connected to the top ends of the rocking members 9 are connecting members 11, using upper pins 10.

The rocking members 9 and connecting members 11 are adapted to move in the direction toward a casting mold, due to the extension and compression of a hydraulic cylinder 12.

An inclining portion 13 is attached to the ends of the connecting members 11 by means of inclination pins P3 but in a position close to the exit of the ladle. The extension or compression of the hydraulic cylinder 14 will cause the inclining members 13 to incline about the pins 3, i.e., a fulcrum P3, toward the casting mold, thereby in turn causing the pouring ladle 6 to incline in the direction toward the casting mold 4.

The pouring ladle 6 has an inclining center P2 or fulcrum in the vicinity of the exit 7 of the ladle and has a partition wall 16 therein between the center of gravity G2 of the melt and the aforesaid inclining center P2. The partition wall 16 has a passage 19 along or close to the bottom of the ladle to permit the mutual communication of melts in the front chamber 17 and a rear chamber 18 separated by the partition wall 16. The passage provided in the partition wall 16 close to the bottom portion of the ladle has a sufficient but minimized cross-sectional area to insure the optimum pouring speed of the melt from the ladle, while communicating the front chamber 17 with the rear chamber 18. The number of the passage should not necessarily be limited to one. The large waves produced on the surface of the melt in the rear chamber 18 having a much larger volume as compared with that of the front chamber 17 will not affect the surface of the melt contained in the front chamber 17. This in turn eliminates a surging phenomenon in the outflowing speed of the melt from the exit 7, thus insuring smooth pouring operation of a melt.

Alternatively, a subsidiary partition wall 16' may be provided between the front chamber 17 and the exit 7, as required, to further improve the pouring condition of a melt from the ladle.

An operation room 15 is provided on the rear portion of the platform car 1. Provided in the operation room are an operating device, a control device and hydraulic units and the like, and an operator deals with travelling of the car, and receiving and pouring of a melt in and from the ladle. In connection to this operation, the inclining speed of the ladle 6 may be varied in proportion to the inclined angle of a lever 20 provided in the operation room, as required. In addition, the braking operation is effected by using a right foot brake pedal, while the synchronous or non-synchronous clutching operation is attended upon by means of a left-foot clutch pedal. The right hand takes care of the inclining movement of the ladle 6 as well as the advancing and retracting movements thereof. The left hand handles the manipulation of the high-speed-travel stopping lever, whereby presenting the ready manipulation of the devices or units mounted on the platform car without requiring skill in a safe manner.

In pouring operation by means of the pouring platform car according to the present invention, the melt is received in the ladle 6 at a melt receiving station, and immediately thereafter the car travels at a high speed to a position to pour the melt into the casting mold 4, after which the platform car will travel at the same speed as that of the mold conveyor 2. Then, the frame body 5 is advanced toward the casting mold 4 by means of the hydraulic cylinder 12 (as required, the cylinder may be moved rearwardly), and then the exit 7 of the ladle 6 is shifted and adjusted to a position adapted to pour the melt into the sprue of the casting mold 4. Then, the inclining member 13, on which is mounted the ladle 6, is inclined about the pin P3, i.e., the fulcrum, by means of the hydraulic cylinder 14 for pouring a melt into the mold.

Upon completion of casting in the first casting mold 4, then the inclining member 13 is returned to its home position, and then the platform car 1 is moved at a high speed to provide for the subsequent pouring in the second casting mold 4. The pouring operation is repeated in the same manner as has been described with reference to the first casting mold. When the melt runs out in the ladle 6, then the platform car is switched to the high speed travelling to receive a new melt in the ladle, thus repeating the aforesaid cycle of operations.

As is apparent from the foregoing description, the platform car according to the present invention may be synchronized with the travelling speed of the mold conveyor 2 or may not be synchronized, as required, and permits the inclination of the ladle 6 as well as the movement in the direction toward a casting mold, while the inclining center P2 or the fulcrum of the ladle is positioned in the vicinity of the exit 7 of the ladle. This permits the safe, efficient, and smooth pouring operations of a melt into a casting mold, even if the ladle is of a great capacity.

Furthermore, according to the pouring ladle of the present invention, the pouring ladle 6 has a partition wall 16 between the inclining center or fulcrum of the ladle and the center of gravity G2 of the melt, with a passage 19 provided in the partition wall 16 along or close to the bottom of the ladle for mutual communication of the melts separated by the partition wall 19 within the ladle. As a result, the wave forming phenomenon due to the repeated inclination or rotation of the pouring ladle 6 may be suppressed, thus insuring a stable pouring operation of a melt into a casting mold.

The configuration of the partition wall 16 of the pouring ladle 6 according to the present invention is similar to that of a slag skimmer, but its functions, construction and efficacies are entirely different.

Figure 7:
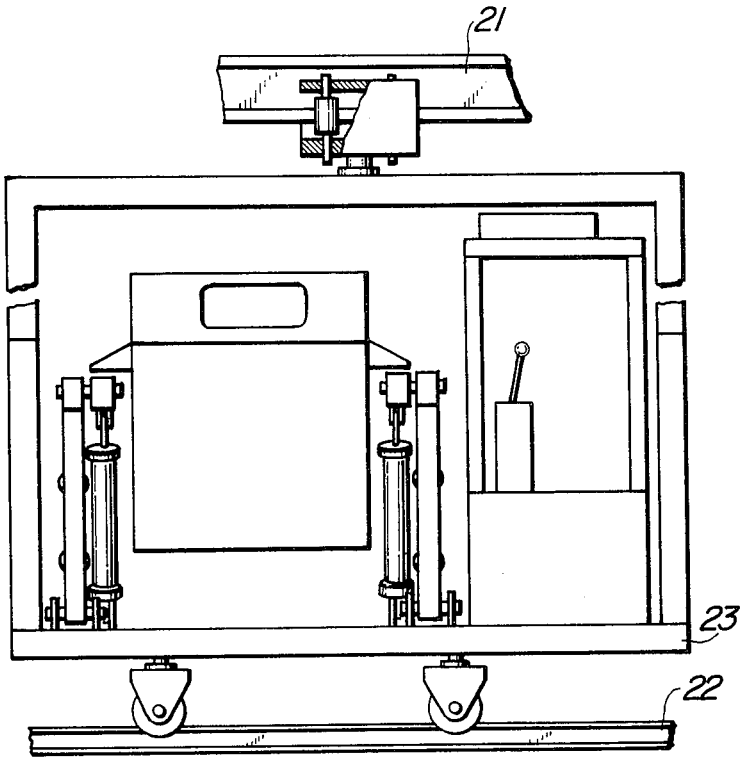
FIGS. 7 and 8 show front and side views of another embodiment of the invention, with an operation room omitted.
Figure 8:
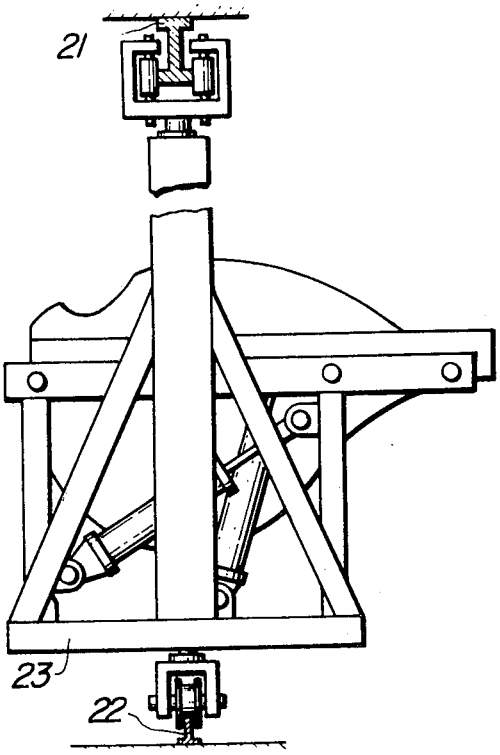

According to the embodiment of the pouring platform car described thus far has four wheels running on two rails. However, as shown in FIGS. 7 and 8, a single suspension type rail 21, and a single rail laid on the ground and a pouring platform car 23 suspended from the suspension type rail 21 but running on the rail 22 on the ground may be used, permitting not only the linear travelling but also curved travelling for the car, presenting a wide range of movement.

The provision of the pouring ladle and pouring platform car according to the present invention provide a safe, smooth and stable pouring operation. As a result, not to mention improvements in the efficiency of the pouring operation, there may be achieved improvements in yield and quality of products.

What is claimed is:

1. A pouring platform car, characterized in that said pouring platform car comprises platform car means capable of moving with a relatively low speed in synchronism or non-synchronism with the speed of a mold conveyor and capable of moving with a relatively high speed irrespective to the speed of the mold conveyor, a frame body mounted on said platform car means such that said frame body can be moved back and forth toward or away from the mold conveyor, and a pouring ladle having a fulcrum as to the inclining motion thereof in the vicinity of a pouring gate, characterized in that said pouring ladle is provided with a partition wall having in the vicinity of the bottom of said ladle a passage through which melt can flow inwardly or outwardly, and said partition wall is provided between said fulcrum and the center of gravity concerning said melt, said pouring ladle being mounted on said frame body in such a manner that said pouring ladle can be freely inclined with the pouring gate directed toward the mold, wherein said car is adapted to run on a single rail laid on the ground in parallel with the mold conveyor.

2. A pouring apparatus comprising a pouring ladle mounted on a frame body, said ladle being rotatable with an axis of rotation in the vicinity of the exit of said ladle, characterized in that said ladle comprises a partition wall having a passage in the vicinity of the bottom of said ladle through which passage melt can flow inwardly or outwardly, said partition wall being provided between said axis of rotation and the center of gravity of said melt, said ladle being adapted to pour melt by rotation thereof such that a wave-forming phenomenon occurring from the movement of the ladle is suppressed by said partition wall, and pulsation of melt-pouring speed from the ladle is prevented by said partition wall.

3. A pouring apparatus as set forth in claim 2, wherein a second partition wall is provided in the vicinity of said exit of said ladle.

4. A pouring apparatus characterized in that said pouring apparatus comprises platform car means for moving with a relatively low speed in synchronism or non-synchronism with the speed of a mold conveyor and for moving with a relatively high speed irrespective of the speed of the mold conveyor, a frame body attached to said platform car means, said frame body being movable back and forth toward or away from the mold conveyor, and a pouring ladle mounted freely rotatable on said frame body with the pouring gate of said ladle directed toward the mold conveyor, said ladle being provided with a partition wall between the axis of rotation of the ladle in the vicinity of the pouring gate and the center of gravity of the melt, said partition wall comprising in the vicinity of the bottom of said ladle a passage for the melt to flow inwardly or outwardly.

5. A pouring apparatus as set forth in claim 4, wherein the pouring platform car is adapted to run on two rails laid on the ground in parallel with the mold conveyor.

6. A pouring apparatus as set forth in claim 4, wherein the platform car is adapted to run on a single rail laid on the ground in parallel with the mold conveyor.

7. A pouring apparatus as set forth in claim 4, wherein the platform car is provided on its rear portion thereof with an operating device, a control device, and hydraulic units and the like.

8. A pouring apparatus as set forth in claim 5, wherein the platform car is provided on its rear portion thereof with an operating device, a control device, and hydraulic units and the like.

9. A pouring apparatus as set forth in claim 6, wherein the platform car is provided on its rear portion thereof with an operating device, a control device, and hydraulic units and the like.

10. A pouring apparatus as set forth in claim 4, wherein the pouring ladle is provided, between said axis of rotation in the vicinity of the pouring gate and the center of gravity of the melt, with a subsidiary partition wall.

11. A pouring apparatus as set forth in claim 4, wherein said frame body comprises a link mechanism including rocking members capable of moving back and forth about a fulcrum of lower pins in a direction at right angles to rails for the pouring apparatus, and connecting members connected through upper pins to the upper parts of said rocking members, and wherein said frame body moves back and forth in the direction of a mold by hydraulic cylinder means.

12. A pouring apparatus as set forth in claim 11, wherein said pouring ladle is attached to inclining members, said inclining members being pivotally connected to ends of said connecting members by means of inclination pins, and wherein said pouring ladle is rotated about said axis of rotation by a second hydraulic cylinder means acting on said inclining members.

13. A pouring ladle comprising:

pivot means for rotating the pouring ladle about an axis of rotation disposed in the vicinity of a pouring gate of said pouring ladle, and means for suppressing wave-formation of melt and preventing pulsation of melt-pouring speed during pouring of said melt from said pouring ladle upon rotation of said pouring ladle about said axis.

14. A pouring ladle according to claim 13, wherein said means for suppressing wave-formation and preventing pulsation of melt-pouring speed include a partition member disposed in said pouring ladle between said pivot means and the center of gravity of said melt, said partition member having at least one passage in the vicinity of the bottom of said pouring ladle for enabling flow of said melt to said pouring gate.

15. A pouring ladle according to claim 14, wherein said at least one passage extends through said partition member at the bottom of the pouring ladle.

16. A pouring ladle according to claim 14, wherein a secondary partition member is further disposed in the vicinity of said pouring gate.

17. A pouring ladle according to claim 13, wherein said pivot means is arranged at said pouring gate.

18. A pouring platform car comprising:

pouring ladle means for pouring melt into at least one mold on a mold conveyor, said pouring ladle means including pivot means for rotating said pouring ladle means about an axis of rotation disposed in the vicinity of a pouring gate of said pouring ladle means, and means for suppressing wave-formation of said melt and preventing pulsation of melt-pouring speed during pouring of said melt;

frame means for mounting said pouring ladle means, said frame means including means for inclining said pouring ladle means by said pivot means, and means for moving said frame means at least toward said mold conveyor independently of said means for inclining said pouring ladle; and platform means for supporting said frame means, said platform means being capable of moving at least at one of a speed in synchronism with said mold conveyor or speeds in non-synchronism with said mold conveyor.

19. A pouring platform car according to claim 18, wherein said platform means is capable of being moved on two rails arranged in parallel with said mold conveyor.

20. A pouring platform car according to claim 18, wherein said platform means is capable of being moved on a single rail arranged in parallel to said mold conveyor.

21. A pouring platform car according to claim 18, wherein said platform means further includes operating means for operating said frame means and control means for controlling said operating means.

22. A pouring ladle according to claim 18, wherein said means for suppressing wave-formation and preventing pulsation of melt-pouring speed include a partition member disposed in said pouring ladle between said pivot means and the center of gravity of said melt, said partition member having at least one passage in the vicinity of the bottom of said pouring ladle for enabling flow of said melt to said pouring gate.

23. A pouring ladle according to claim 22, wherein said at least one passage extends through said partition member at the bottom of the pouring ladle.

24. A pouring ladle according to claim 22, wherein a secondary partition member is further disposed in the vicinity of said pouring gate.

25. A pouring ladle according to claim 18, wherein said pivot means is arranged at said pouring gate.

26. A pouring platform car according to claim 18, wherein said frame means includes pivotal frame members arranged in a framework, and said means for moving includes a hydraulic means for moving said pivotal frame members at right angles to a direction of movement of said platform means.

27. A pouring platform car according to claim 26, wherein said means for inclining include inclining frame members supporting said pouring ladle means and pivotally connected to a portion of said pivotal frame means at said pivot means of said pouring ladle means, and second hydraulic means for moving said inclining members such that said pouring ladle means is rotated by said pivot means about said axis of rotation.

* * * * *